US006022264A

United States Patent [19]

Cook et al.

[11] Patent Number: 6,022,264

[45] Date of Patent: Feb. 8, 2000

[54] POLISHING PAD AND METHODS RELATING THERETO

[75] Inventors: Lee Melbourne Cook, Steelville, Pa.; David B. James, Newark; William D. Budinger, Wilmington, both of Del.

[73] Assignee: Rodel Inc., Newark, Del.

[21] Appl. No.: 09/021,437

[22] Filed: Feb. 10, 1998

Related U.S. Application Data

[60] Provisional application No. 60/037,582, Feb. 10, 1997.

[51] Int. Cl.[7] ..... B24B 1/00

[52] U.S. Cl. ..... 451/37; 51/298; 451/56; 451/58; 451/59; 451/72; 451/527; 451/550

[58] Field of Search ..... 451/56, 527, 550, 451/548, 36, 37, 57, 58, 59, 72; 51/298

[56] References Cited

U.S. PATENT DOCUMENTS 4,788,798 12/1988 DeFranco et al. ..... 451/527
5,152,917 10/1992 Pieper et al. .
5,304,223 4/1994 Peiper et al. .
5,435,816 7/1995 Spurgeon et al. .
5,527,368 6/1996 Supkis et al. .
5,722,106 3/1998 Masterman et al. ..... 451/527

*Primary Examiner*—Timothy V. Eley
*Attorney, Agent, or Firm*—Konrad H. Kaeding; Kenneth A. Benson

[57] ABSTRACT

A chemical-mechanical polishing system which is particularly well suited for use in the manufacture of semiconductor devices or the like. The invention is directed to a self-dressing, hydrophilic polishing pad capable of releasing particles during polishing. Such a pad design is very efficient in providing polishing particles over the entire polishing surface interface. Since the polishing pad produces polishing particles, the polishing fluid can comprise very low loadings of polishing particles, if any.

18 Claims, 1 Drawing Sheet

POLISHING PAD AND METHODS RELATING THERETO

This application claims the benefit of U.S. Provisional Application No. 60/037,582 filed Feb. 10, 1997.

BACKGROUND OF THE INVENTION

1. Field of the Invention

The present invention relates generally to a chemical-mechanical polishing system which is particularly well suited for use in the manufacture of semiconductor devices or the like. More particularly, the compositions and methods of the present invention are directed to a self-dressing polishing pad capable of releasing particles during use.

2. Discussion of Related Art

Integrated circuit manufacture often includes the planarization or polishing of: 1. semiconducting materials, such as silicon or gallium arsenide; 2. insulating materials, such as, silicon dioxide; and/or 3. conducting materials, such as tungsten, aluminum or copper. Each type of polishing may require different polishing materials and/or techniques, depending upon the particular composition of the layer being polished. A need exists in the manufacture of semiconducting devices for a polishing system having improved reliability and adaptability to different planarization polishing needs.

Conventional slurry based polishing systems produce large amounts of particle residue which must be washed away or otherwise removed during the semiconductor chip manufacturing process. A need therefore also exists for a planarization polishing system which produces less particle debris than conventional systems.

U.S. Pat. No. 5,435,816 to Spurgeon, et al, is directed to an abrasive article having a sheet-like structure for use in abrasion-type polishing of substrates.

SUMMARY OF THE INVENTION

The present invention is directed to a polishing system comprising a polishing pad having a surface layer. The surface layer comprises a self-dressing matrix which diminishes during polishing in increments of less than 1 micron. The matrix exhibits a modulus in the range of 1 to 200 MegaPascals, a critical surface tension greater than or equal to 34 milliNewtons per meter, and an elongation to break in the range of 25% to 1000%. The matrix also defines a three dimensional surface texture, whereby as the surface texture wears during polishing, the amount of surface contact between the matrix material and a polishing substrate changes by less than 25%. A plurality of polishing particles are encompassed within the matrix or otherwise arise from the matrix. The particles have a size and a shape which render them incapable of defining a Mohs' hardness. The particles have an average aggregate diameter of less than 1 micron, more preferably less than 0.5 microns, and the matrix is free of particles greater than or equal to 1 micron in diameter.

In one embodiment, the pads of the present invention are used in conjunction with a polishing fluid having a low loading of particulate matter, if any. In a process embodiment of the present invention, a polishing fluid having 0–2 weight percent particulate matter is recovered, rejuvenated and recycled.

To provide consistency of polishing performance, any polishing pad flow channel(s) should have a configuration whereby as the pad wears to one half the average depth of the largest flow channel, the amount of surface area capable of contacting the substrate changes by less than 25%, more preferably less than 15% and most preferably less than 10%.

BRIEF DESCRIPTION OF THE DRAWINGS

FIG. 2 is a schematic side view of the polishing pad and polishing slurry of the present invention as used to planarize a substrate for use in the manufacture of a semiconductor device or the like.

DETAILED DESCRIPTION OF THE PREFERRED EMBODIMENT(S)

Figure 1:
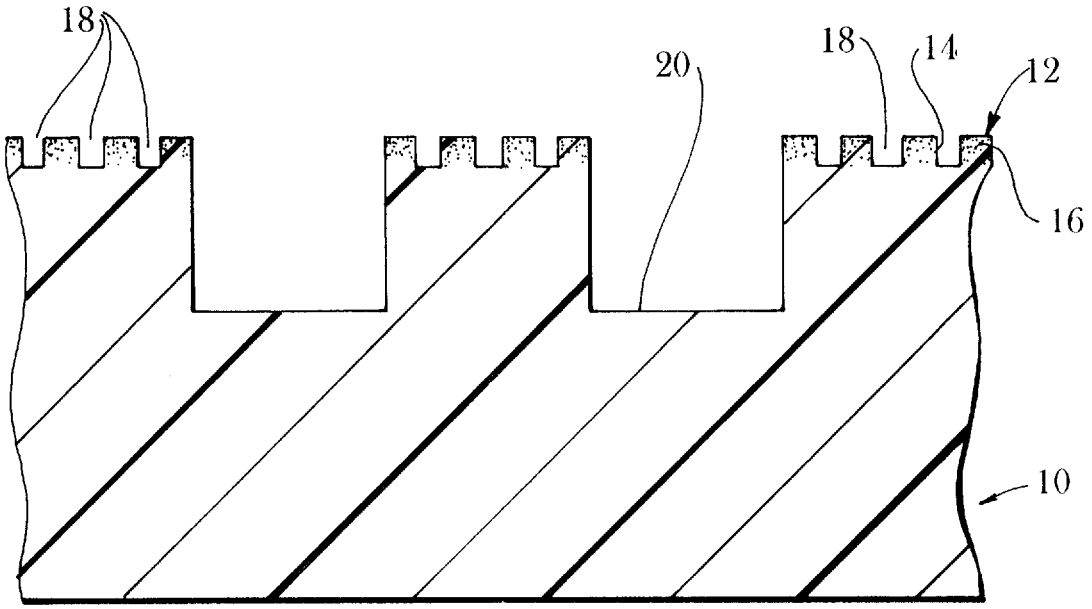
FIG. 1 is an enlarged end sectional view showing a polishing pad in accordance with the present invention.

The present invention is directed to a mono-layer or multilayer polishing pad having an innovative surface layer. The surface layer provides the polishing surface and comprises a self-dressing matrix containing a plurality of particles. "Self-dressing" is intended to mean that the matrix abrades, dissolves or otherwise diminishes during the polishing operation, thereby exposing the particles within the matrix to the polishing interface. Preferably, the matrix diminishes during polishing in increments of less than 1 micron. Preferably, the weight ratio of particles to matrix material is in the range of 5:1 to 0.1:1, more preferably 0.5:1 to 1:1.

Particles which can be incorporated into the matrix material in accordance with the present invention include:

1. alumina,
2. silicon carbide,
3. chromia,
4. alumina-zirconia,
5. silica,
6. diamond,
7. iron oxide,
8. ceria,
9. boron nitride,
10. boron carbide,
11. garnet,
12. zirconia, and
13. combinations thereof.

Preferred particles have an average particle size of less than 0.5 microns but preferably greater than or equal to 0.05 microns, more preferably the particles are in the range of 0.1 to 0.4 microns. The particles of the present invention have an average aggregate diameter of less than 0.5 microns. To avoid unwanted scratching or scoring of the surface, the matrix is preferably free of particles greater than or equal to 1 micron in diameter. In an alternative embodiment, the particles presented by the self-dressing matrix are merely increments of the matrix of less than one micron which separate from the matrix during polishing.

The particles are of a size and shape which renders them incapable of defining a Mohs' hardness. Mohs' hardness is a measure of surface scratching or fracturing, and the polishing pads of the present invention remove surface protrusions without undue fracturing or scratching, thereby providing sufficient smoothness (planarization) to meet the polishing requirements of the computer chip manufacturing industry. Polishing in accordance with the present invention is directed to the removal of surface protrusions by severing the chemical bonds between the protrusion and the surface. This is a much different mechanism than fracturing, cutting or abrading.

In one embodiment, the particles are at least about 50 weight percent, more preferably 80 weight percent and most preferably greater than 95 weight percent oxide particles having an average surface area ranging from about 25 square meters per gram to about 430 square meters per gram and an average aggregate diameter of less than about 0.5 microns. Preferred oxide particles of the present invention are alumina, silica, iron oxide and ceria.

The surface area of the particles can be measured by the nitrogen adsorption method of S. Brunauer, P. H. Emmet and I. Teller, J. Am. Chemical Society, Volume 60, page 309 (1938) which is commonly referred to as BET measurement. Aggregate size can be determined by known techniques, such as, that described in ASTM D3849-89; measurements can be recalled individually or in the form of statistical or histogram distributions. Aggregate size distribution can be determined by transmission electron microscopy (TEM) The mean aggregate diameter can be determined by the average equivalent spherical diameter when using TEM image analysis, i.e., based upon the cross-sectional area of the aggregate.

Preferably, the particles are non-agglomerated and are dispersed within the matrix material. The matrix material comprises at least a binder component which can be any material having properties sufficient to bind the particles within the matrix and form a continuous pad layer. Preferably, the medium is "self-dressing" which means that it gradually abrades, dissolves or otherwise diminishes during polishing, thereby exposing and presenting particles contained within the matrix to the polishing interface on a continuous or discontinuous basis, preferably continuous. In this way, a renewal of particles is presented to the polishing interface, thereby providing improved consistency in polishing performance. The particles will preferably induce planarization polishing while bonded to the medium (and exposed at the surface of the matrix) and/or thereafter when the particle is no longer bonded to the matrix (as the matrix diminishes during polishing, particles will tend to separate from the pad).

The matrix material is sufficiently hydrophilic to provide a critical surface tension greater than or equal to 34 milliNewtons per meter, more preferably greater than or equal to 37 and most preferably greater than or equal to 40 milliNewtons per meter. Critical surface tension defines the wettability of a solid surface by noting the lowest surface tension a liquid can have and still exhibit a contact angle greater than zero degrees on that solid. Thus, polymers with higher critical surface tensions are more readily wet and are therefore more hydrophilic. Critical Surface Tension of common polymers are provided below:

| Polymer | Critical Surface Tension (mN/m) |
|---|---|
| Polytetrafluoroethylene | 19 |
| Polydimethylsiloxane | 24 |
| Silicone Rubber | 24 |
| Polybutadiene | 31 |
| Polyethylene | 31 |
| Polystyrene | 33 |
| Polypropylene | 34 |
| Polyester | 39–42 |
| Polyacrylamide | 35–40 |
| Polyvinyl alcohol | 37 |
| Polymethyl methacrylate | 39 |
| Polyvinyl chloride | 39 |
| Polysulfone | 41 |
| Nylon 6 | 42 |

-continued

| Polymer | Critical Surface Tension (mN/m) |
|---|---|
| Polyurethane | 45 |
| Polycarbonate | 45 |

In one embodiment, the pad matrix is derived from at least:

1. an acrylated urethane;
2. an acrylated epoxy;
3. an ethylenically unsaturated organic compound having a carboxyl, benzyl, or amide functionality;
4. an aminoplast derivative having a pendant unsaturated carbonyl group;
5. an isocyanurate derivative having at least one pendant acrylate group;
6. a vinyl ether,
7. a urethane
8. a polyacrylamide
9. an ethylene/ester copolymer or an acid derivative thereof;
10. a polyvinyl alcohol;
11. a polymethyl methacrylate;
12. a polysulfone;
13. an polyamide;
14. a polycarbonate;
15. a polyvinyl chloride;
16. an epoxy;
17. a copolymer of the above; or
18. a combination thereof.

Preferred matrix materials comprise urethane, carbonate, amide, sulfone, vinyl chloride, acrylate, methacrylate, vinyl alcohol, ester or acrylamide moieties. The matrix material also preferably defines a modulus of 1 to 200 MegaPascals. Preferably the matrix material defines an elongation to break in the range of 25% to 1000%, more preferably 50%–500% and most preferably 100%–350%. The matrix can be porous or non-porous. In one embodiment, the matrix is non-porous; in another embodiment, the matrix is non-porous and free of fiber reinforcement.

The matrix material is preferably created by polymerizing a binder precursor, wherein the binder precursor is combined with the particles (and other optional ingredients, if any) and thereafter polymerized to provide a continuous matrix layer containing the particles.

A preferred binder precursor is one capable of being cured or polymerized via any appropriate polymerization mechanism, such as substitution, addition or condensation polymerization reactions. A preferred polymerization reaction involves a free radical mechanism. Suitable binder precursors include acrylated urethanes, acrylated epoxies, ethylenically unsaturated compounds, aminoplast derivatives having pendant alpha,beta-unsaturated carbonyl groups, isocyanurate derivatives having at least one pendant acrylate group, isocyanate derivatives having at least one pendant acrylate group, and combinations thereof. In a preferred embodiment, the binder precursor comprises an ethylenically unsaturated compound, such as an acrylate monomer. In one embodiment, the binder precursor is trimethylolpropane triacrylate.

If either ultraviolet radiation or visible radiation is to be used to initiate polymerization, it is preferred that the binder precursor further comprise a photoinitiator. Examples of photoinitiators that generate a free radical source include, but are not limited to: organic peroxides, azo compounds, quinones, benzophenones, nitroso compounds, acyl halides, hydrazones, mercapto compounds, pyrylium compounds, triacrylimidazoles, bisimidazoles, phosphene oxides, chloroalkyltriazines, benzoin ethers, benzil detals, thioxanthones, acetophenone derivatives and combinations thereof.

Cationic photoinitiators generate an acid source to initiate the polymerization of an epoxy resin; examples of such photoinitiators include: salts having an onium cation, halogen containing complex anions of a metal or metalloid, salts having an organometallic complex cation, halogen containing complex anions of a metal or metalloid, and ionic salts of an organometallic complex in which the metal is selected from the elements of Periodic Group IVB, VB, VIB, VIIB and VIIIB. Such photoinitiators are well known and need not be described further here.

In addition to the radiation curable resins, the binder precursor may further comprise resins that are curable by sources of energy other than radiation energy, such as condensation curable resins. Examples of such condensation curable resins include phenolic resins, melamine-formadehyde resins, and urea-formaldehyde resins.

Optionally, a diluent can be added prior to polymerization to provide a softer final matrix material or otherwise make it more prone to wear, to dissolving or to otherwise diminishing during polishing. In one embodiment, the diluent is a polyol, such as, polyethylene glycol, methoxypolyethylene glycol, polypropylene glycol, polybutylene glycol, glycerol, polyvinyl alcohol, and combinations thereof. In one embodiment, the diluent is polyethylene glycol having an average molecular weight of from 200 to 10,000 and comprising 20 to 60 weight percent of the matrix material.

Optionally, an oxidizing component can be incorporated into the matrix material to promote oxidation of a metal layer to its corresponding oxide. For example, an oxidizing component can be used to oxidize tungsten to tungsten oxide; thereafter, the tungsten oxide can be chemically and/or mechanically polished and removed. Preferred oxidizing components for incorporation into the matrix include oxidizing salts, oxidizing metal complexes, iron salts, such as nitrates, sulfates, potassium ferri-cyanide and the like, aluminum salts, quaternary ammonium salts, phosphonium salts, peroxides, chlorates, perchlorates, permanganates, persulfates and mixtures thereof. The amount should be sufficient to ensure rapid oxidation of the metal layer while balancing the mechanical and chemical polishing performance of the system. Other possible additives include fillers, fibers, lubricants, wetting agents, pigments, dyes, coupling agents, plasticizers, surfactants, dispersing agents and suspending agents. The matrix material can comprise up to 80 weight percent filler and other optional ingredients. Examples of optional additives include EDTA, citrates, polycarboxylic acids and the like. Although certain clays have been described as being capable of acting as polishing particles, for purposes of the present invention, the presence of clay materials within the matrix are to be deemed as filler, not polishing particles.

The matrix material of the polishing pads of the present invention is preferably created by mixing the particles and any optional ingredients together with the binder precursor. The resulting mixture is then applied to a substrate as the precursor is polymerized to create the particle filled matrix material. The substrate upon which the matrix is applied can be left bonded to the matrix material to form a multilayer pad; in such an embodiment, the polymerization reaction should induce adhesion between the substrate and matrix material, and the substrate should be prone to surface wetting by the precursor matrix material. In an alternative embodiment, the matrix material is peeled away from the substrate to form a monolayer; this monolayer can be used as a pad or additional layers can be applied to the monolayer to provide a multilayered pad. Regardless of whether the final pad is a monolayer or multilayer, the particle containing matrix material will define at least one polishing surface of the pad.

The preferred first step in manufacturing the matrix material of the present invention is to prepare a particulate slurry by any suitable mixing technique. The slurry comprises the binder precursor, the particles and other optional additives, if any. Examples of suitable mixing techniques include low shear and high shear mixing; high shear mixing being preferred. Ultrasonic energy may also be utilized in combination with the mixing step to lower the slurry viscosity. Typically, the particles are gradually added into the binder precursor. The amount of air bubbles in the slurry can be minimized by pulling a vacuum during or after the mixing step. In some instances, it may be preferred to add heat during mixing, generally in the range of 30 to 70 degrees Centigrade, to lower viscosity. The slurry should have a rheology that coats well and in which the particles and other fillers do not settle.

A preferred slurry comprises a free radical curable binder precursor. Such polymerization can generally be initiated upon exposure to thermal or electromagnetic energy, depending upon the free radical initiator chemistry used. The amount of energy necessary to induce polymerization depends upon several factors such as the binder precursor chemistry, the dimensions of the matrix precursor material, the amount and type of particles and the amount and type of optional additives. Possible radiation energy sources include electron beam, ultraviolet light or visible light. Electron beam radiation, which is also known as ionizing radiation can be used at an energy level of about 0.1 to about 10 Mrad, preferably within the range of about 250–400 nanometers. Also preferred is visible light radiation in the range of about 118 to 236 Watts per centimeter; visible radiation refers to non-particulate radiation having a wavelength within the range of about 400 to about 800 nanometers, preferably in the range of about 400 to 550 nanometers. It is also possible to use thermal energy to initiate the free radical polymerization, provided the polymerization chemistry is adaptable to thermally induced free radical initiation and curing.

The matrix precursor can be partially or wholly polymerized upon a belt, a sheet, a web, a coating roll (such as a rotogravure roll, a sleeve mounted roll) or a die. The substrate can be composed of metal (e.g., nickel), metal alloys, ceramic or plastic. The substrate may contain a release coating (e.g., a fluoropolymer) to permit easier release of the cured matrix material from the substrate.

In one embodiment, partial or complete polymerization of the polymer precursor occurs with the material in contact with a mold or other means to induce a three dimensional pattern upon a surface of the matrix. Alternatively, the surface of the matrix can modified by any available technique, such as, photolithography and/or machining. In yet another alternative embodiment, the matrix surface is not modified, but rather, the surface texture remains that which was naturally produced when hardening (e.g. polymerizing) the precursor to provide the solid matrix material.

Conventional polishing pads generally perform better with a series of large and small flow channels. Such flow channel geometry is less critical however for the pads of the present invention, because the pads generate polishing particles during use, and therefore do not require that the polishing fluid transport polishing particles throughout the polishing interface. In one embodiment of the present invention, only the polishing fluid need be uniformly transported along the pad surface, and this is much easier and less dependent upon flow channel geometry, particularly since the matrix material is hydrophilic. In another embodiment of the present invention, flow channels are unnecessary or are otherwise sufficiently inherent in the matrix material. In a preferred embodiment of the present invention, the flow channels continuously evolve (some are created as others diminish), as the matrix abrades, dissolves or otherwise diminishes.

To provide consistency of polishing performance, any flow channel(s) should have a configuration whereby as the pad wears to one half the average depth of the flow channel, the amount of surface area capable of contacting the substrate changes by less than 25%, more preferably less than 15% and most preferably less than 10%. In one embodiment, the flow channel(s) define a groove having a floor and a pair of walls, and each wall exists in a plane which defines an angle to the (plane of the) floor in the range of 70–110 degrees; this definition intends to include curved or otherwise non-planar walls, wherein a plane is conceptualized which permeates the middle region of the wall and is approximately equal-distant from the top and bottom edges of the wall.

The polishing systems of the present invention comprise the (above described) polishing pad in combination with a polishing fluid. Any conventional polishing fluid can be used, including a conventional particle based polishing slurry. More preferred however are polishing fluids having less than 15 weight percent particulate matter, more preferably less than 10% and yet more preferably less than 5 weight percent particulate matter. In one preferred embodiment, the polishing fluid comprises 0–2 weight percent particles. In another embodiment, the polishing fluid comprises an amine, halogen ion and/or oxidizing agent.

During polishing, preferred polishing fluids provide increased reactivity or corrosivity at the point of particle contact or interaction with a surface protrusion. For example, if the polishing fluid is more corrosive at higher temperatures, then corrosion will preferentially occur at this point of contact, since the temperature at the point of contact is generally higher than at non-contact portions of the surface. A particularly preferred polishing fluid provides a corrosion rate which increases as the protrusion is stressed (i.e., bond strain is induced) due to particle contact or interaction.

Dilute solutions of hydrofluoric acid are corrosive to $SiO_2$ and silicate materials. The rate of corrosion is sensitive to bond strain, particularly tensile strain. The corrosion rate increases by more than an order of magnitude. Such a reactive solution when used in accordance with the polishing pads of the present invention will generally result in a highly selective local removal in the proximal vicinity of the particle contact, due to the increased local bond strain in the substrate.

The polishing fluid embodiment of the present invention for use in the polishing of silicon is a water based polishing fluid, comprising about 0.05 to about 5 weight percent amine, preferably primary amine capable of receiving a free proton. In addition or in the alternative to the amine the following can be used: a halogen ion, particularly a fluoride ion; a hydroxyl ion; and/or a superoxide, such as peroxide, persulfate, permagnate or the like. A preferred pH for the polishing fluid of this embodiment is in the range of about 4–12.

In another embodiment, the polishing fluid is recycled back into the polishing operation. Prior to re-use, the polishing fluid can be filtered or otherwise processed or rejuvenated.

Since the polishing fluids of the present invention have extremely low loadings of particulate matter (if any), the polishing fluid is more easily recycled. Preferably, the polishing fluid is filtered after use to remove any contamination due to pad wear, substrate polishing byproduct or the ambient environment. In some cases, further conditioning of the used polishing fluid may be useful, such as by ion exchange or precipitation, particularly where ions or ion complexes are formed by the polishing process. Substrate cleaning after polishing is also generally easier.

Another advantage is the ease with which the polishing fluid can be treated to preserve its activity as it is recycled. For example, if a dilute hydrofluoric acid solution is employed, the pH and HF concentration may be precisely measured in situ before and after use. Provisions for additional HF into the solution as needed to maintain a constant acid concentration and pH can be easily introduced into the recirculation system. Similarly, for a polishing fluid comprising 50 parts per million ozone in water at pH 4, the oxidation potential of the solution (which is directly proportional to the ozone concentration), and the pH may be measured with conventional electrodes; acid and ozone can then be added during the recirculation process to maintain consistency in polishing fluid performance.

Figure 2:
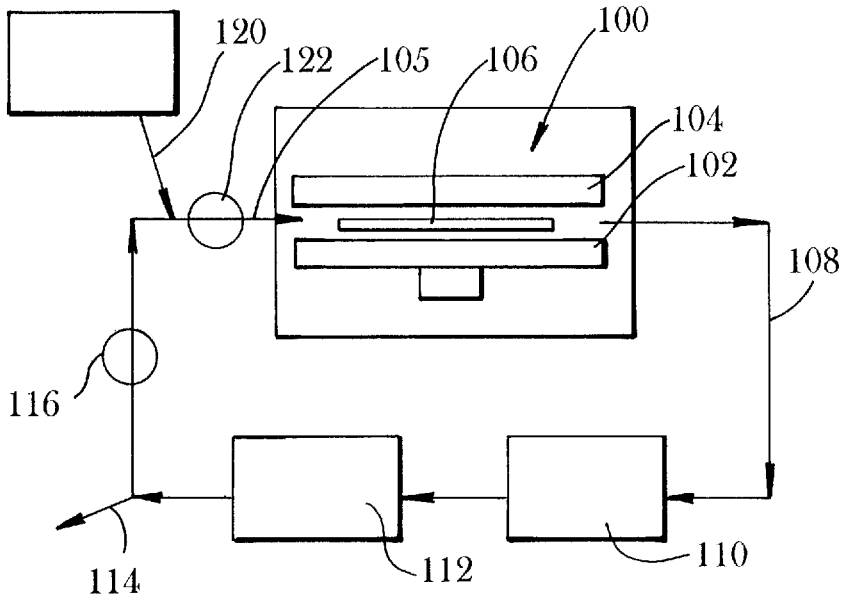

Referring now to the drawings, FIG. 1 is an enlarged sectional view showing a polishing pad in accordance with the present invention. The pad 10 comprises a polishing surface 12 comprising a matrix 14 having particles 16. Optional flow channels are shown at 18 and 20. FIG. 2 provides a schematic representation of a polishing process in accordance with the present invention. The polishing apparatus is shown generally at 100, comprising a table 102, workpiece 106 and polishing pad 104. Polishing fluid is pumped into the polishing interface (between the pad and workpiece) by influent line 105. Used polishing fluid exits the polishing apparatus via effluent line 108. The used polishing fluid is filtered by filter 110, and deionized by ion exchange column 112. Excess polishing fluid can be removed by waste line 114. Sensor 116 then monitors the pH or other chemical properties of the recycled fluid, and inlet line 120 provides appropriate additives to the recycled fluid, thereby rejuvenating it for another polishing cycle. Sensor 122 monitors the polishing fluid entering the polishing operation to ensure proper pH or other properties which are desired to be monitored for quality control.

Nothing from the above discussion is intended to be a limitation of any kind with respect to the present invention. All limitations to the present invention are intended to be found only in the claims, as provided below.

What is claimed is:

1. A method of polishing, comprising:

placing a polishing fluid having 0–2 weight percent particulate matter into an interface between a polishing pad and a substrate, the substrate containing at least one of silicon, gallium arsenide, silicon dioxide, tungsten, aluminum, and copper, the polishing pad having a surface layer, the surface layer comprising:

a self-dressing matrix containing a plurality of particles, the matrix having a modulus in the range of 1 to 200 MegaPascals, a critical surface tension greater than or equal to 34 milliNewtons per meter, and an elongation to break in the range of 25% to 1000%, the matrix having a planar polishing surface with a surface area that is engagable with the substrate during polishing, and a three dimensional surface texture defining at least one flow channel in the polishing surface, whereby as the matrix wears during polishing, the surface area of the polishing surface changes by less than 25%, and the particles having an average aggregate diameter of less than 0.5 microns, the matrix being free of any particles greater than or equal to 1 micron in diameter, whereby as the particles separate from the matrix during polishing of the substrate, the matrix diminishes in increments of less than 1 micron.

2. A method in accordance with claim 1, whereby the substrate comprises a surface and a plurality of protrusions chemically bonded to the surface and as the polishing fluid and the pad move over the protrusions, a plurality of chemical bonds between the protrusions and the substrate surface are stressed by the polishing particles and the chemical bonds are then broken due to interaction with the polishing fluid, thereby removing the protrusions from the surface without fracturing or scratching the surface.

3. A method in accordance with claim 1 further comprising:

collecting at least a portion of the polishing fluid from the polishing interface, filtering the collected polishing fluid and returning the collected polishing fluid back into the polishing interface.

4. A method in accordance with claim 1 further comprising: modifying the pH of the collected polishing fluid prior to returning the collected polishing fluid back into the polishing interface.

5. A method of polishing in accordance with claim 1, wherein the particles have a size and a shape which render them incapable of defining a Mohs' hardness.

6. A polishing system comprising:

a polishing pad having a surface layer, the surface layer comprising a self-dressing matrix containing a plurality of particles, the matrix having a modulus in the range of 1 to 200 MegaPascals, a critical surface tension greater than or equal to 34 milliNewtons per meter, and an elongation to break in the range of 25% to 1000%, the matrix having a planar polishing surface with a surface area that is engagable with a substrate during polishing, and a three dimensional surface texture defining a plurality of flow channels each extending to a respective depth below the polishing surface, whereby as the matrix wears to one half the depth of a largest said flow channel, the surface area of the polishing surface changes by less than 25%, and the particles having an average aggregate diameter of less than 0.5 micron, the matrix being free of any particles greater than or equal to 1 micron in diameter, whereby as the particles separate from the matrix during polishing of the substrate, the matrix diminishes in increments of less than 1 micron.

7. A polishing system in accordance with claim 6 wherein as the matrix wears during polishing, the surface area of the polishing surface changes by less than 15%.

8. A polishing system in accordance with claim 6 wherein the average aggregate diameter of the particles is in the range of 0.1 to 0.4 microns, at least 50 weight percent of the particles are at least one of alumina, silica, ceria, and iron oxide particles, and a weight ratio of the particles to matrix material is in the range of 5:1 to 0.1:1.

9. A polishing system in accordance with claim 6 wherein the matrix comprises at least one of urethane, carbonate, amide, sulfone, vinyl chloride, acrylate, methacrylate, vinyl alcohol, ester and acrylamide moieties.

10. A polishing system in accordance with claim 6 wherein the matrix material comprises a polyol.

11. A polishing system in accordance with claim 6 further comprising a polishing fluid, the polishing fluid comprising less than 15 weight percent particulate matter.

12. A polishing system in accordance with claim 11 wherein the polishing fluid comprises 0–2 weight percent particulate matter.

13. A polishing system in accordance with claim 12, wherein the polishing fluid comprises at least one of an amine, polycarboxylic acid, halogen ion, and an oxidizing agent.

14. A polishing system in accordance with claim 6, wherein the particles have a size and a shape which render them incapable of defining a Mohs' hardness.

15. A polishing pad comprising a surface layer, the surface layer comprising a self-dressing matrix which diminishes into a plurality of particles during polishing, the particles having an average aggregate diameter of less than 1 micron, the matrix being free of any particles greater than or equal to 1 micron in diameter, the matrix having a polishing surface with a surface area that is engagable with a substrate during polishing, and a three dimensional surface texture, whereby as the matrix wears during polishing, the surface area of the polishing surface changes by less than 25%, the matrix comprising at least one of urethane, carbonate, amide, sulfone, vinyl chloride, acrylate, methacrylate, vinyl alcohol, ether, ester and acrylamide moieties.

16. A polishing pad in accordance with claim 15, wherein the matrix is non-porous and whereby as the matrix wears during polishing, the surface area of the polishing surface changes by less than 15%.

17. A polishing pad in accordance with claim 16, wherein the matrix is free of fiber reinforcement.

18. A polishing pad in accordance with claim 15, wherein the particles have a size and a shape which render them incapable of defining a Mohs' hardness.

* * * * *